United States Patent [19]

Chappelow, Jr. et al.

[11] Patent Number: 4,513,828

[45] Date of Patent: Apr. 30, 1985

[54] PILE DRIVING CAP BLOCK CUSHION ASSEMBLY

[75] Inventors: Cecil C. Chappelow, Jr.; Thomas J. Byerley, both of Johnson County, Kans.

[73] Assignee: Conmaco, Inc., Kansas City, Kans.

[21] Appl. No.: 473,268

[22] Filed: Mar. 8, 1983

[51] Int. Cl.[3] ..... B23B 45/16

[52] U.S. Cl. ..... 173/139

[58] Field of Search ..... 428/206, 283, 325, 372, 428/375, 378, 395, 403, 404, 406, 407, 327, 394; 173/128, 131, 139

[56] References Cited

U.S. PATENT DOCUMENTS 3,669,823 6/1972 Wood ..... 428/293

*Primary Examiner*—James J. Bell

*Attorney, Agent, or Firm*—Kokjer, Kircher, Bradley, Wharton, Bowman & Johnson

[57] ABSTRACT

An improved pile driving cap block cushion material is the subject of this invention. The material is a thermoplastic material characterized by being in particulate form, fiber filled (preferably glass fiber filled), having a melting point of 125° C. or higher, a secant modulus of elasticity of from 50,000 to 800,000 p.s.i. and a coefficient of restitution of from 0.4 to 0.9. A number of thermoplastic materials are suitable for forming the material of the invention and include polyamides, polyesters, polyolefins, polycarbonates, polyimides, polyamide-imide copolymers, acetal homopolymers, acetal copolymers, fluoroplastics, polyphenyl oxides, copolyesters, polyetherimides, polystyrenes, polyvinyls, and polysulfones. A particularly useful group of materials is poly(ethylene terephthalate), poly(butylene terephthalate), nylon 6 and nylon 66. Additives such as antioxidants, heat stabilizers, reinforcers and colorants may also be added.

13 Claims, 1 Drawing Figure

PILE DRIVING CAP BLOCK CUSHION ASSEMBLY

BACKGROUND OF THE INVENTION

This invention relates generally to pile driving and, more particularly, to a pile driving cap block cushion having improved physical and chemical properties.

In the accompanying drawing, the single FIGURE is a perspective view of a pile driving helmet employing a cap block cushion according to the present invention.

It is known in pile driving operations to place a helmet 10 (see accompanying drawing) over the pile. On concrete piles a cushion is interposed between the pile and the helmet. The helmet protects the pile from direct blows by the pile driving hammer. The helmet includes a cone portion 12 for receiving a cap block cushion material 14. An anvil or striker plate 16 is then placed over the cushion material for direct contact by the pile driving hammer. The configuration of the helmet as well as the technique of placing the helmet over the pile and then striking it with the pile driving hammer is well known to those skilled in the art. For example, a typical helmet configuration and illustration of its use is contained in the publication *Glossary of Foundation Terms,* published by The Deep Foundations Institute, Springfield, N.J. (1981).

The cap block cushion material performs two major functions: (1) it protects both the pile and the hammer from the destructive forces which would result from direct contact, and (2) it modulates the blow of the hammer, absorbing high frequency inefficient peak forces and transfers the energy of the moving ram to the pile in the form of a uniform "push". The energy absorbed by the cushion material is transformed into heat which may be destructive of the cushion.

The primary cap block cushion material heretofore utilized was green oak wood. While the performance of this material was generally satisfactory, its relatively short life and high cost led the industry to investigate other materials. One alternative cap block cushion material comprised a block of asbestos fibers in an organic binder. It has been observed, however, that during use of such a material asbestos fibers will become airborne and thus cause a health hazard. Other materials which have been utilized to some degree as cap block cushions include canvas impregnated with phenolic resin, steel mesh coated with epoxy resin, nylon 6, styrene butadiene rubbers, and acrylonitrilebutadiene rubbers. While in some instances the foregoing materials have performed satisfactorily for a limited period of time, lack of thermal stability has limited useful life. All of the foregoing materials have heretofore been sold in block or sheet form which requires that a number of different sizes be inventoried to accommodate the different size helmets which are used in pile driving.

SUMMARY AND OBJECTS

The present invention provides for an improved cap block cushion comprising a thermoplastic material in particulate form. Preferably, the material is reinforced with glass fibers.

It is, therefore, a primary object of the present invention to provide an improved pile driving cap block cushion which may be utilized in particulate form thereby eliminating the need to inventory numerous sizes of cushions.

Another very important object of our invention is to provide a cap block cushion which is environmentally safe during both storage and usage.

One of the further objectives of the invention is to provide a thermoplastic cap block cushion which incorporates glass fibers that improve the physical properties of the cushion.

Another aim of our invention is to provide a thermoplastic cap block cushion which exhibits superior thermal stability at the temperatures encountered during pile driving operations.

A further one of the objects of our invention is to provide an improved cap block cushion whieh is initially present in solid form and during pile driving operations will form a liquid center which will enhance the stability of the cushion as the pile driving operation continues.

Other objects of the invention will be made clear or become apparent from the following description and claims.

DETAILED DESCRIPTION OF THE INVENTION

Figure 1:
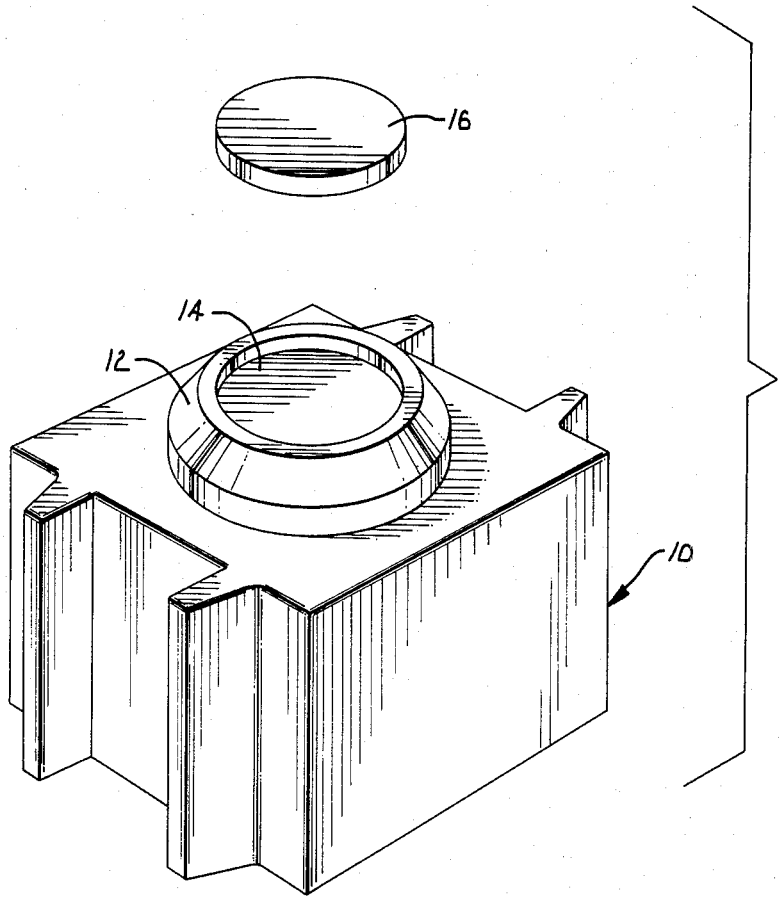

One of the most important criteria for a cap block cushion is that it have relative thermal stability at the temperatures encountered during pile driving operations. In order to meet this criteria, the material used in the composition of this invention should have a melting point of around 125° C. or higher, preferably over 200° C.

A known indicator of the physical property of materials is the secant modulus of elasticity. This term is well known to those skilled in the art and is defined by the formula $E_s=F/S$ where F is the stress increment in pounds/square inch (p.s.i.) based on the final load and the initial load, and S is the strain based on the initial and final specimen lengths. Basically, the secant modulus is a measure of the stiffness of a material. The greater the value, the stiffer the material.

Another known indicator of the physical properties of a material is the coefficient of restitution. This is defined by the formula $$E=\sqrt{\frac{A_2}{A_1}}$$

where where $A_1$ is the area under the loading curve on a plot of load versus deflection, and $A_2$ is the area under the unloading curve on a plot of load versus deflection. The coefficient of restitution is basically a measure of the energy absorption character of the material. The greater the value, the less energy absorbed. Procedures for measuring the secant modulus of elasticity and the coefficient of restitution are discussed in "Proposed Standard Method of Testing For Load Deflection Characteristics of Cushion Material Used in Pile Driving", published by The Deep Foundations Institute, 1982.

It has been found that greatly improved results are obtainable utilizing certain thermoplastic materials according to the present invention, which materials are present in particulate form. By utilizing the material in particulate form, the helmet cone may be filled from a single source of cushion material regardless of the size of the cone. Manifestly, this greatly reduces inventory requirements. The presence of the material in particulate form may also improve its performance, although the exact mechanism by which this occurs is not fully understood. The exact size of the particles is not critical although best results will be obtained if they are at least $\frac{1}{8}$ inch in diameter and $\frac{1}{8}$ to $\frac{1}{4}$ inch in length. Equivalent dimensions (or larger) in other configurations can be employed. The material should also be small enough in size to be free flowing and not create excessive voids when poured into the helmet cone.

Thermoplastic materials characterized by relative thermal stability at the temperatures encountered during pole driving operations and therefore utilizable for forming a cushion according to the present invention include polyamides, polyesters, polyolefins, polycarbonates, polyimides, polyamide-imide copolymers, acetal homopolymers, acetal copolymers, fluoroplastics, polyphenyl oxides, copolyesters, polyetherimides, polystyrenes, polyvinyls, and polysulfones. The foregoing materials may be used individually or in mixtures. It is also desirable that the material have a secant modulus of elasticity of from 50,000 to 800,000 p.s.i. and a coefficient of restitution of from 0.4 to 0.9.

It is highly desirable that the material be fiber filled with an environmentally safe material. The fibers will add strength to the material and increase the secant modulus of elasticity. Glass fiber is the preferred filler, being present by up to 40% by weight. Other filler and reinforcing materials which could be utilized with the thermoplastic materials of the invention include fibrous materials such as aramid fibers or equivalent fibrous materials, carbon/graphite fibers, and inorganic fillers such as calcium carbonate, calcium sulfate, or equivalents. Still other fibers and fillers can be utilized if they are thermally stable, compatible and environmentally safe.

A particularly useful group of materials in the invention is poly(ethylene terephthalate), poly(butylene terephthalate), nylon 6 and nylon 66. It may also be desirable to admix one of the foregoing with up to 10% by weight of a polyolefin such as polyethylene. The preferred material is glass filled nylon 66 having a fiber content of 30–40% by weight.

Known additives to improve the performance of thermoplastic materials can be utilized with the cushion materials of the present invention. These include antioxidants, heat stabilizers, reinforcers and colorants. Some examples of the foregoing which may be employed in the present invention include titanium dioxide, chromates, and carbon black. While neat polymers have been found to perform satisfactorily in most instances, it may also be desirable to utilize immiscible polymer blends in some applications to improve performance.

It has been found particularly advantageous to employ the cap block cushion materials of the invention in a helmet cone where a special drive cap is employed which incorporates a sealing gasket around its periphery to reduce the loss of particulate material from the cone during the pile driving operation.

It has been observed that the cushion materials according to the invention will heat during use from the center outwardly when present in the cone of the pile driving helmet. As the decomposition temperature of the material is approached, a liquid forms that is encapsulated in the center of the cushion by the fused particulate material which forms a block around it. Again, the exact mechanism for energy transfer is not fully understood, but it is thought that the presence of the encapsulated liquid may be a factor in stabilizing the cushion material against decomposition during the remainder of the pile driving operation. This may be partially attributable to the insulating characteristics of the thermoplastic materials employed.

The following are specific examples of materials which can be used in forming a cap block cushion according to the present invention: high molecular weight polyethylene, ultra high molecular weight polyethylene (M.W.=3 to 6 million); poly(ethylene terephthalate); poly(butylene terephthalate); nylon 6; nylon 66; mixtures of glycols such as ethylene glycol and butylene glycol with dibasic acids such as phthalic, isophthalic and terephthalic; aromatic dianhydrides polymerized with aromatic diamines; trimellitic anhydride polymerized with aromatic amines; polyvinyl acetate, polyvinyl butyral, polyvinyl formyl; Delrin, an acetal resin sold by E. I. du Pont de Nemours & Co.; Celons, an acetal resin sold by Celanese; Noryl, a polyphenylene oxide sold by General Electric; Lexan, a polycarbonate sold by General Electric Co.; Merlon, a polycarbonate sold by Mobay Chemical Co.; and Ulem, a polyetherimide sold by General Electric.

We claim:

1. A pile driving assembly comprising:

a helmet adapted to be placed in overlying relationship to the pile being driven, said helmet having a cone portion for receiving a cushion material; and a fiber filled thermoplastic cushion material in particulate form disposed in said cone portion, said cushion material undergoing partial deformation during a pile driving operation to form an encapsulated liquid center within said helmet, whereby pile driving forces are transmitted through said thermoplastic material while some shock forces are absorbed by said material.

2. A pile driving assembly as set forth in claim 1, wherein said thermoplastic material is characterized by a melting point of at least 125° C.

3. A pile driving assembly as set forth in claim 3, wherein said thermoplastic material is glass fiber filled.

4. A pile driving assembly as set forth in claim 1, wherein said thermoplastic material is characterized by a secant modulus of elasticity of from 50,000 p.s.i. to 800,000 p.s.i. and a coefficient of restitution of from 0.4 to 0.9.

5. A pile driving assembly as set forth in claim 1, wherein said thermoplastic material comprises one or more members of the group consisting of polyamides, polyesters, polyolefins, polycarbonates, polyimides, polyamide-imide copolymers, acetal homopolymers, acetal copolymers, fluoroplastics, polyphenyl oxides, copolyesters, polyetherimides, polystyrenes, polyvinyls, and polysulfones.

6. A pile driving assembly as set forth in claim 1, wherein said thermoplastic material comprises one or more members of the group consisting of poly(ethylene terephthalate), poly(butylene terephthalate), nylon 6 and nylon 66.

7. A pile driving assembly as set forth in claim 1, wherein said thermoplastic material comprises nylon 66.

8. A pile driving assembly as set forth in claim 1, wherein said thermoplastic material is glass fiber filled, said glass fibers comprising up to 40% by weight of said material.

9. A pile driving assembly as set forth in claim 8, wherein said thermoplastic material is characterized by a melting point of at least 125° C.

10. A pile driving assembly as set forth in claim 8, wherein said thermoplastic material comprises one or more members of the group consisting of polyamides, polyesters, polyolefins, polycarbonates, polyimides, polyamide-imide copolymers, acetal homopolymers, acetal copolymers, fluoroplastics, polyphenyl oxides, copolyesters, polyetherimides, polystyrenes, polyvinyls, and polysulfones.

11. A pile driving assembly as set forth in claim 10, wherein said thermoplastic material is characterized by a secant modulus of elasticity of from 50,000 p.s.i. to 800,000 p.s.i. and a coefficient of restitution of from 0.4 to 0.9.

12. A pile driving assembly as set forth in claim 8, wherein said thermoplastic material comprises one or more members of the group consisting of poly(ethylene terephthalate), poly(butylene terephthalate), nylon 6 and nylon 66.

13. A pile driving assembly as set forth in claim 8, wherein said thermoplastic material comprises nylon 66.

* * * * *

UNITED STATES PATENT AND TRADEMARK OFFICE

CERTIFICATE OF CORRECTION

PATENT NO. : 4,513,828

DATED : April 30, 1985

INVENTOR(S) : Cecil C. Chappelow, Jr.; Thomas J. Byerley

It is certified that error appears in the above–identified patent and that said Letters Patent are hereby corrected as shown below:

Claim 3, line 1, delete the numeral "3" and substitute therefor: -- 1 --.

Signed and Sealed this

*Twenty-seventh* Day of *August 1985*

[SEAL]

*Attest:*

DONALD J. QUIGG

*Attesting Officer* *Acting Commissioner of Patents and Trademarks*